US012127596B2

(12) United States Patent
Zhou et al.

(10) Patent No.: US 12,127,596 B2
(45) Date of Patent: Oct. 29, 2024

(54) CIGARETTE DEVICE

(71) Applicant: SHENZHEN SMOORE TECHNOLOGY LIMITED, Guangdong (CN)

(72) Inventors: Hongming Zhou, Shenzhen (CN); Jiao Zhang, Shenzhen (CN); Junjie Xiao, Shenzhen (CN); Biao Chen, Shenzhen (CN)

(73) Assignee: SHENZHEN SMOORE TECHNOLOGY LIMITED, Shenzhen (CN)

( * ) Notice: Subject to any disclaimer, the term of this patent is extended or adjusted under 35 U.S.C. 154(b) by 318 days.

(21) Appl. No.: 17/694,123

(22) Filed: Mar. 14, 2022

(65) Prior Publication Data

US 2022/0232895 A1 Jul. 28, 2022

Related U.S. Application Data

(63) Continuation of application No. PCT/CN2020/114371, filed on Sep. 10, 2020.

(30) Foreign Application Priority Data

Sep. 19, 2019 (CN) ..... 201910884667.5

(51) Int. Cl.
*A24F 40/465* (2020.01)
*A24F 40/20* (2020.01)
(Continued)

(52) U.S. Cl.
CPC ..... *A24F 40/465* (2020.01); *A24F 40/20* (2020.01); *A24F 40/485* (2020.01); *A24F 40/51* (2020.01); *A24F 40/57* (2020.01)

(58) Field of Classification Search
CPC ..... A24F 40/465; A24F 40/20; A24F 40/485; A24F 40/51; A24F 40/57; A24F 40/53; A24F 40/50
See application file for complete search history.

(56) References Cited

U.S. PATENT DOCUMENTS 6,040,560 A 3/2000 Fleischhauer et al.
10,058,130 B2 * 8/2018 Monsees ..... A24F 40/42
(Continued)

FOREIGN PATENT DOCUMENTS

CN 101940369 A 1/2011
CN 103190705 A 7/2013
(Continued)

OTHER PUBLICATIONS

European Patent Office, Search Report in European Patent Application No. 20865622.3 (Sep. 21, 2023).
(Continued)

*Primary Examiner* — Truc T Nguyen
(74) *Attorney, Agent, or Firm* — Leydig, Voit & Mayer, Ltd.

(57) ABSTRACT

A cigarette device includes a housing, and a loading cavity, an airflow sensor, a circuit control unit, and a power supply are disposed in the housing. A fluid channel is located between the loading cavity and the housing, and the fluid channel is in communication with the outside of the housing and the inside of the loading cavity. An electromagnetic induction heating element surrounds the outside of the loading cavity; and the electromagnetic induction heating element is electrically connected to the power supply, and the circuit control unit is electrically connected to the airflow sensor and the electromagnetic induction heating element. When the cigarette device is used in combination with a cigarette added with a magnetic material, the cigarette can be heated uniformly and generate vapor quickly, to ensure a
(Continued)

consistent vaping taste and improve utilization of tobacco while achieving immediate vaping and immediate stopping, which helps improve user experience.

20 Claims, 3 Drawing Sheets

(51) Int. Cl.

| | |
|---|---|
| ***A24F 40/485*** | (2020.01) |
| ***A24F 40/51*** | (2020.01) |
| ***A24F 40/57*** | (2020.01) |

(56) References Cited

U.S. PATENT DOCUMENTS

| | | | | |
|---|---|---|---|---|
| 10,104,915 | B2 * | 10/2018 | Bowen | H05B 1/0244 |
| 10,279,934 | B2 * | 5/2019 | Christensen | B65B 3/18 |
| 2014/0270727 | A1 * | 9/2014 | Ampolini | A24F 40/50 392/394 |
| 2017/0215477 | A1 * | 8/2017 | Reevell | A24F 40/90 |
| 2017/0340018 | A1 * | 11/2017 | Thorens | H05B 3/44 |
| 2020/0375256 | A1 * | 12/2020 | Chong | A24F 40/51 |

FOREIGN PATENT DOCUMENTS

| | | | |
|---|---|---|---|
| CN | 103734910 | A | 4/2014 |
| CN | 103750566 | A | 4/2014 |
| CN | 103783668 | A | 5/2014 |
| CN | 104095295 | A | 10/2014 |
| CN | 204273231 | U | 4/2015 |
| CN | 104824851 | A | 8/2015 |
| CN | 206079037 | U | 4/2017 |
| CN | 207613192 | U | 7/2018 |
| CN | 108634380 | A | 10/2018 |
| CN | 109247619 | A | 1/2019 |
| CN | 109259310 | A | 1/2019 |
| CN | 211510581 | U | 9/2020 |
| KR | 200491034 | Y1 | 2/2020 |
| WO | 2017109448 | A2 | 6/2017 |
| WO | 2019030364 | A1 | 2/2019 |
| WO | 2019088611 | A2 | 5/2019 |

OTHER PUBLICATIONS

Patent Cooperation Treaty, International Search Report, International Application No. PCT/CN2020/114371 (Dec. 9, 2020).
Patent Cooperation Treaty, Written Opinion of the International Searching Authority, International Application No. PCT/CN2020/114371 (Dec. 9, 2020).
Chinese Patent Office, Office Action in Chinese Patent Application No. 201910884667.5 (Jun. 29, 2024).

* cited by examiner

CIGARETTE DEVICE

CROSS-REFERENCE TO RELATED APPLICATIONS

This application is a continuation of International Application No. PCT/CN2020/114371, filed on Sep. 10, 2020, which claims priority to Chinese Patent Application No. 201910884667.5, filed on Sep. 19, 2019. The disclosures of the aforementioned applications are hereby incorporated by reference in their entireties.

TECHNICAL FIELD

This application relates to the field of electronic cigarette technologies, and in particular, to a cigarette device.

BACKGROUND

A low-temperature baking cigarette device is a cigarette device that heats a baked item (such as a cigarette) with a low temperature in a certain manner to generate vapor for a user to inhale. Current low-temperature baking cigarette devices generally use a heating element to heat a cigarette. The heating element is in direct contact with the cigarette, generates heat through the Joule effect, and transmits the heat to the cigarette to implement baking. Heating elements on the market are mainly in three forms: internal heating plates, core heating rods, and external heating tubes. However, these heating elements all have the following defects: on one hand, the cigarette is preheated for a relatively long time, leading to an inconsistent vaping taste, and tobacco near the heating element may be easily charred to generate a burnt taste; on the other hand, once the cigarette device is started, the whole cigarette needs to be consumed at one time, and the vaping process cannot be stopped and resumed in the middle.

SUMMARY

According to embodiments of this application, a cigarette device is provided, including:

- a housing;
- a loading cavity, disposed in the housing and configured to load a cigarette;
- a fluid channel, located between the loading cavity and the housing, the fluid channel being in communication with the outside of the housing and a loading chamber of the loading cavity;
- an airflow sensing apparatus, disposed in the housing, the airflow sensing apparatus being disposed in the fluid channel to sense an airflow speed in the fluid channel;
- a power supply, disposed in the housing;
- an electromagnetic induction heating element, surrounding the outside of the loading cavity, the electromagnetic induction heating element being electrically connected to the power supply; and
- a circuit control unit, disposed in the housing, the circuit control unit being electrically connected to the airflow sensing apparatus and the electromagnetic induction heating element, and controlling, according to the airflow speed sensed by the airflow sensing apparatus, the electromagnetic induction heating element to work or stop.

In an embodiment, a material of the loading cavity is a non-magnetic shielding heat sink material with a thermal conductivity not lower than 20 W/(m·K).

In an embodiment, a material of the loading cavity is a ceramic material with a thermal conductivity not lower than 20 W/(m·K).

In an embodiment, the housing is provided with a cigarette insertion opening, the loading cavity is connected to the cigarette insertion opening, and the loading chamber of the loading cavity is in communication with the cigarette insertion opening.

In an embodiment, the housing is provided with a first air hole in communication with the fluid channel.

In an embodiment, there are one or more first air holes, and at least one of the first air holes is provided at an upper part of the housing.

In an embodiment, the first air holes are annular through holes surrounding the cigarette insertion opening.

In an embodiment, there are a plurality of first air holes, and the plurality of first air holes are arranged on an outer side of the cigarette insertion opening at uniform intervals.

In an embodiment, there are a plurality of first air holes, and at least one of the first air holes is provided at a lower part of the housing and located below the loading cavity.

In an embodiment, the loading cavity is provided with a second air hole in communication with the fluid channel.

In an embodiment, the second air hole is provided at a bottom wall of the loading cavity.

In an embodiment, there are a plurality of second air holes, and the plurality of second air holes are uniformly provided at the bottom wall of the loading cavity.

In an embodiment, there is one second air hole, and a hole diameter of the second air hole is equal to an inner diameter of the loading cavity.

In an embodiment, a support element is further included, and the loading cavity is connected to an inner wall of the housing through the support element.

In an embodiment, the support element is disposed at a bottom of the loading cavity, and the support element is an annular element.

In an embodiment, the support element is provided with a third air hole in communication with the fluid channel.

Details of one or more embodiments of this application are provided in the accompanying drawings and descriptions below. Other features, objectives, and advantages of this application will become apparent from this specification, the accompanying drawings, and the claims.

To better describe and illustrate embodiments and/or examples disclosed herein, reference may be made to one or more accompanying drawings. Additional details or examples used to describe the accompanying drawings should not be considered as limiting the scope of any of the disclosed application, currently described embodiments and/or examples, and the best modes of the applications currently understood.

DETAILED DESCRIPTION

To help understand this application, the following describes this application more fully with reference to the related accompanying drawings. Exemplary embodiments of this application are provided in the accompanying drawings. However, this application may be implemented in many different forms, and is not limited to the embodiments described in this specification. On the contrary, the embodiments are provided to make understanding of the disclosed content of this application more comprehensive.

It should be noted that, when an element is referred to as "being fixed to" another element, the element may be directly on the another element, or an intervening element may be present. When an element is considered to be "connected to" another element, the element may be directly connected to the another element, or an intervening element may also be present. The terms "vertical", "horizontal", "left", and "right" and similar expressions used in this specification are merely used for the purpose of description, and "outer" and "inner" are relative to a profile of a structure.

Unless otherwise defined, meanings of all technical and scientific terms used in this specification are the same as those usually understood by a person skilled in the art to which this application belongs. In this application, terms used in the specification of this application are merely intended to describe objectives of the specific embodiments, but are not intended to limit this application.

Figure 1:
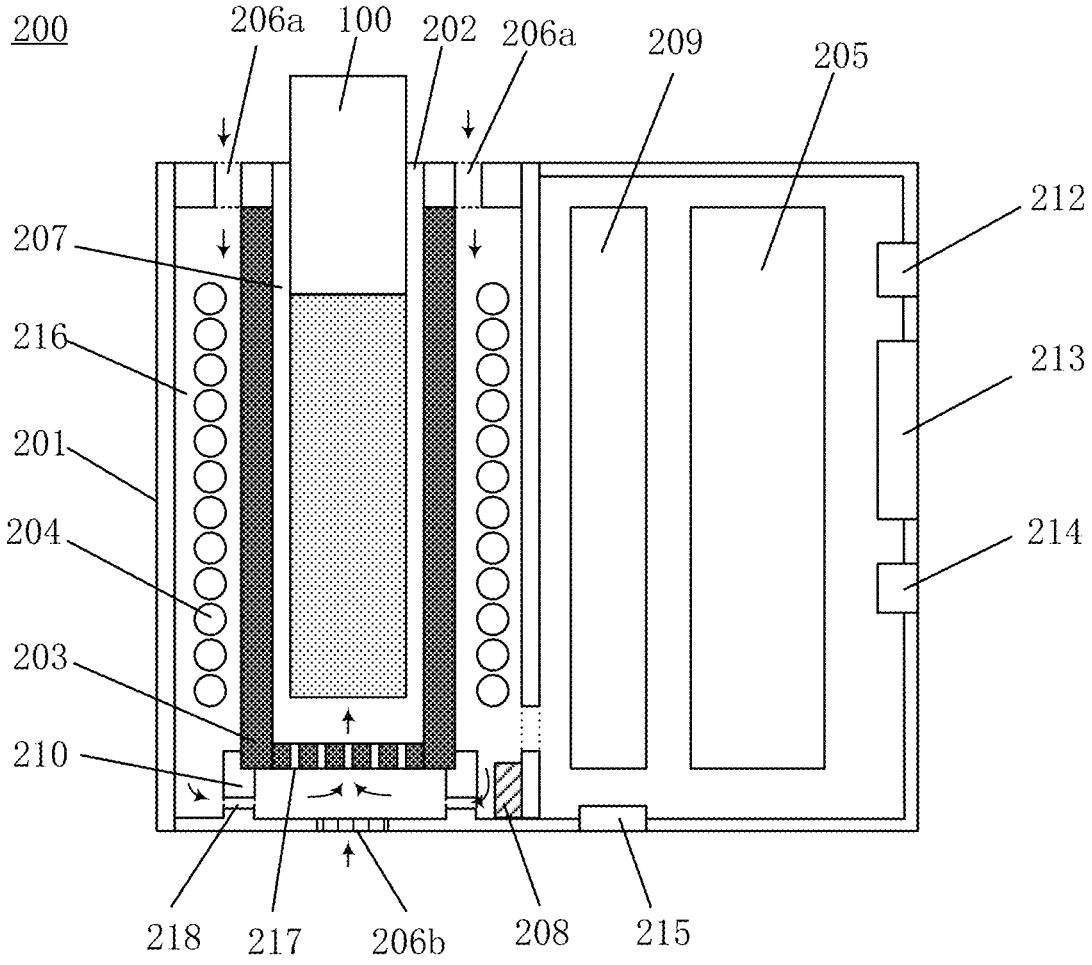
FIG. 1 is a cross-sectional view of a cigarette device according to an implementation.

Referring to FIG. 1, a cigarette device 200 is provided according to an implementation. The cigarette device 200 includes a housing 201, and a loading cavity 203, a power supply 205, an airflow sensing apparatus 208, and a circuit control unit 209 are disposed in the housing 201.

The housing 201 is provided with a cigarette insertion opening 202, and the loading cavity 203 is disposed in the housing 201 and connected to the cigarette insertion opening 202. The loading cavity 203 is configured to load a cigarette 100, and a loading chamber 207 of the loading cavity 203 is in communication with the cigarette insertion opening 202.

An electromagnetic induction heating element 204 surrounds the outside of the loading cavity 203, and the electromagnetic induction heating element 204 is electrically connected to the power supply 205. The cigarette device 200 may be used in combination with a cigarette 100 including a magnetic material. In such a cigarette, the magnetic material is uniformly distributed in tobacco and in direct contact with the tobacco. In this way, in a working state of the cigarette device 200, the electromagnetic induction heating element 204 generates a high-frequency magnetic field; the magnetic materials in the cigarette generate heat quickly under magnetic induction Eddy current and magnetic hysteresis, and transmits the heat to the tobacco quickly, so that the preheating time of the cigarette is reduced, thereby achieving quick cigarette lighting for vaping. In addition, the entire cigarette is approximately heated at the same time, achieving higher utilization of the tobacco, and a burnt taste due to charred tobacco is avoided, thereby obtaining a relatively good taste. The electromagnetic induction heating element 204 may be an electromagnetic induction coil and surrounds the outside of the loading cavity 203 in a winding manner.

After the cigarette 100 is loaded into the loading cavity 203, the cigarette is in close contact with a cavity wall of the loading cavity 203. A fluid channel 216 is formed between the loading cavity 203 and the housing 201, and the fluid channel 216 is in communication with the outside of the housing 201 and the loading chamber 207 of the loading cavity 203. The circuit control unit 209 is electrically connected to the electromagnetic induction heating element 204 and the airflow sensing apparatus 208. The airflow sensing apparatus 208 is disposed in the fluid channel 216 to sense an airflow speed in the fluid channel 216, and the circuit control unit 209 controls, according to the airflow speed sensed by the airflow sensing apparatus 208, the electromagnetic induction heating element 204 to work or stop. In this way, when the cigarette 100 is vaped by using the cigarette device 200, air may enter the housing 201 and enter the loading cavity 203 through the fluid channel 216; the airflow sensing apparatus 208 senses airflow changes and feeds back an electrical signal to the circuit control unit 209; the circuit control unit 209 controls the electromagnetic induction heating element 204 to apply a high-frequency alternating electric field to generate a high-frequency alternating magnetic field in the loading cavity 203, and the magnetic material in the cigarette generates heat quickly under the action of electromagnetic induction to bake the cigarette. After the vaping is stopped, the airflow sensing apparatus 208 may sense that the airflow stops and feed back an electrical signal to the circuit control unit 209; the circuit control unit 209 controls the electromagnetic induction heating element 204 to stop applying the high-frequency alternating electric field, and heating is stopped immediately. Therefore, the cigarette device 200 allows for immediate vaping and immediate stopping. It is unnecessary to vape the whole cigarette at one time. When the vaping is resumed from interruption, the cigarette is still baked uniformly and quickly according to the foregoing process, and no abnormal taste is generated.

To prevent the magnetic material in the cigarette from being interfered, a material for manufacturing the loading cavity 203 needs to have a non-magnetic shielding property, for example, paramagnetism or diamagnetism. Further, the material of the loading cavity 203 is a heat sink material with a thermal conductivity not lower than 20 W/(m·K). The material has good thermal conduction performance and a temperature thereof may not rise significantly with a high temperature of the cigarette during vaping, which helps the cigarette cool to a low temperature quickly after vaping is stopped, thereby further achieving immediate vaping and immediate stopping and ensuring a good taste when the vaping process is resumed from interruption. Specifically, the material of the loading cavity 203 may be a ceramic material such as aluminum oxide or aluminum nitride with a thermal conductivity not lower than 20 W/(m·K).

Figure 2:
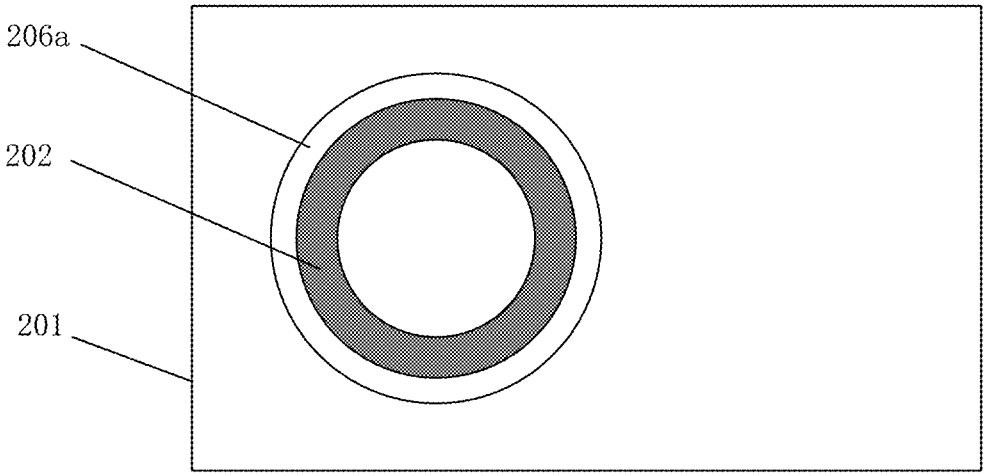
FIG. 2 is a top view of the cigarette device in FIG. 1.
Figure 3:
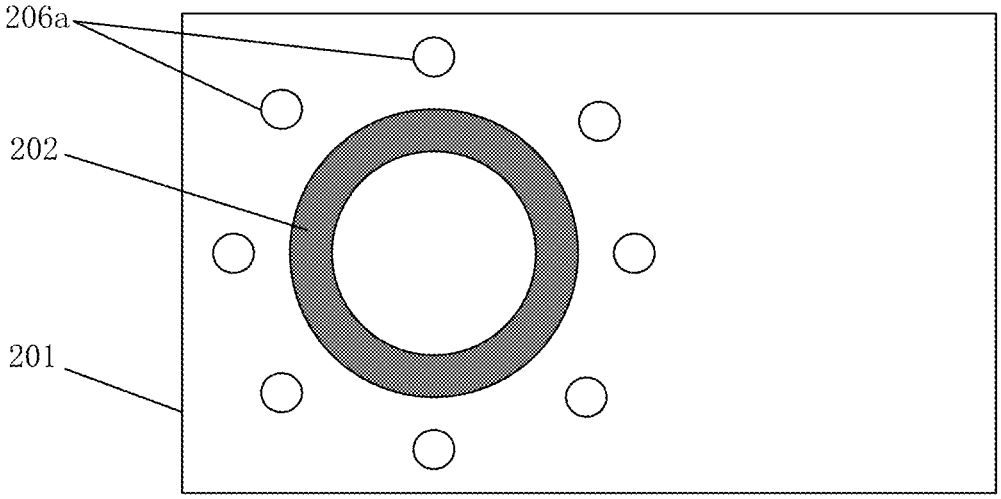
FIG. 3 is a top view of a cigarette device according to another implementation.

Further, the housing 201 may be provided with a first air hole 206 in communication with the fluid channel 216, to achieve communication between the fluid channel 216 and the outside of the housing 201. That is, air may enter the fluid channel 216 through the first air hole 206. There may be one or more first air holes 206. In an embodiment, as shown in FIG. 1, at least one first air hole **206*a* is provided at an upper part of the housing 201. In this case, the first air hole 206*a* may be an annular through hole surrounding the cigarette insertion opening 202 as shown in FIG. 2; or as shown in FIG. 3, a plurality of first air holes 206*a* are arranged on an outer side of the cigarette insertion opening 202** at uniform intervals.

Figure 4:
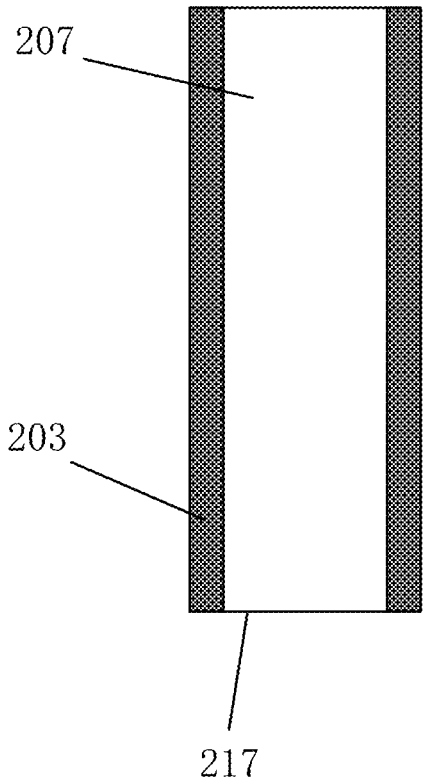
FIG. 4 is a cross-sectional view of a loading cavity in a cigarette device according to another implementation.

The loading cavity 203 may be provided with a second air hole 217 in communication with the fluid channel 216, to achieve communication between the fluid channel 216 and the loading chamber 207. There may be one or more second air holes 217. The second air hole 217 may be provided at a side wall and/or a bottom wall of the loading cavity 203. In an embodiment, the second air hole 217 is provided at the bottom wall of the loading cavity 203. In this case, a plurality of second air holes 217 may be disposed uniformly as shown in FIG. 1. Alternatively, one second air hole 217 may be disposed and a hole diameter of the second air hole 217 is equal to an inner diameter of the loading cavity 203. That is, in this embodiment, the bottom wall of the loading cavity 203 is fully opened, as shown in FIG. 4. In addition, when the second air hole 217 is provided at the bottom wall of the loading cavity 203, at least one first air hole 206*b* may be further provided at a lower part of the housing 201, and the first air hole 206*b* is located below the loading cavity 203, so that a part of air enters the housing 201 through the first air hole 206*b* and further enters the loading chamber 207 through the second air hole 217 at the bottom wall of the loading cavity 203 during usage, and this part of air helps further adjust an airflow amount and resistance against vaping, thereby providing a better vaping experience.

The airflow sensing apparatus 208 may be disposed at any position that helps sense airflow in the housing 201, for example, disposed near the first air hole 206 or disposed near the second air hole 217.

To improve the stability of the loading cavity 203 in the housing 201, a support element 210 configured to support the loading cavity 203 may be further disposed, and the loading cavity 203 is connected to an inner wall of the housing 201 through the support element 210. In an embodiment, the support element 210 may be disposed at a bottom of the loading cavity 203 and is an annular element, to achieve good support and fixing functions. In this case, if the first air hole 206*a* is provided only at the outer side of the cigarette insertion opening 202 and the second air hole 217 is provided at the bottom wall of the loading cavity 203, the support element 210 needs to be provided with a third air hole 218 in communication with the fluid channel 216 to allow air entering the housing 201 from the first air hole 206*a* to enter the loading chamber 207 through the third air hole 218 and the second air hole 217 sequentially. The support element 210 may be manufactured with the housing 201 at the same time or may be an independent element.

In this way, during usage, an airflow channel shown by arrows in FIG. 1 may be formed in the cigarette device 200. External air enters the housing 201 from the first air hole 206*a* on the outer side of the cigarette insertion opening 202, moves downward, and then moves upward to enter the loading chamber 207 through the third air hole 218 of the support element 210 and the second air hole 217 at the bottom wall of the loading cavity 203. A part of heat generated by the electromagnetic induction heating element 204 during working can be taken away by airflow, to cool down the electromagnetic induction heating element 204 and an outer side wall of the loading cavity 203, reduce heat transmitted to the housing 201, and prevent the temperature from being excessively high when the cigarette device is held. In addition, heated air entering the cigarette also improves utilization of energy.

The cigarette device 200 may further include conventional components in this field, such as a switch 212, a display screen 213, a control button 214, and a charging interface 215, and the foregoing components may be disposed on the housing 201.

Figure 5:
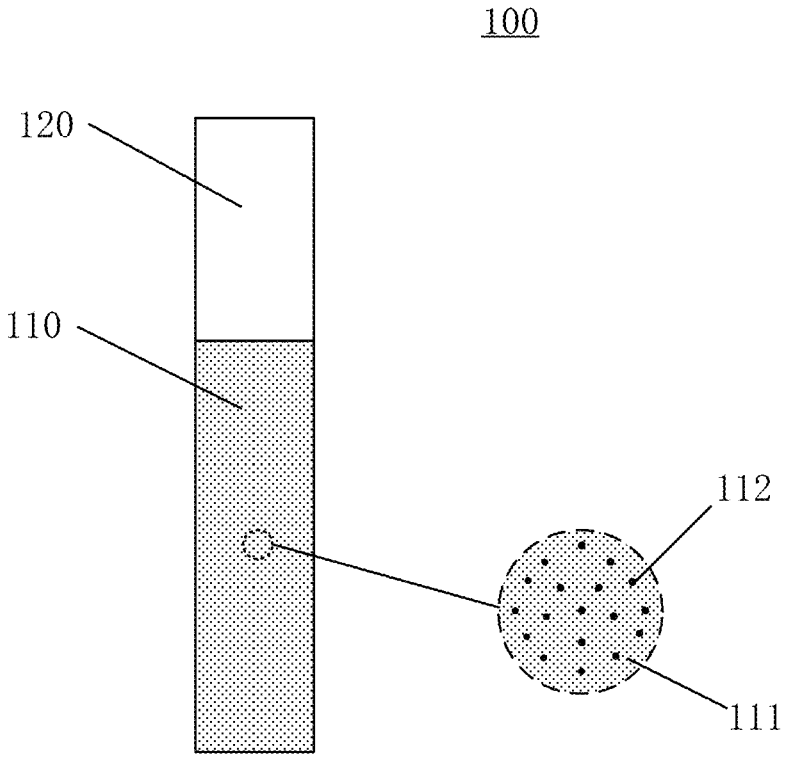
FIG. 5 is a schematic structural diagram of a cigarette used in combination with the cigarette device in FIG. 1.

The following briefly describes a cigarette 100 that can be vaped by using the foregoing cigarette device 200 according to an implementation. Referring to FIG. 5, the cigarette 100 includes a cigarette body 110 and a filter 120, and the cigarette body 110 is connected to the filter 120. The filter 120 includes a function of condensing and filtering vapors.

The cigarette body 110 includes tobacco 111 and a magnetic material 112 uniformly distributed in the tobacco 111. The magnetic material 112 is used for heating the tobacco 111 under the action of electromagnetic induction. That is, under the action of electromagnetic induction, a temperature of the magnetic material 112 rises, and heat is transmitted to the tobacco 111 to bake the tobacco 111. Since the magnetic material 112 is uniformly distributed in the tobacco 111, under the action of electromagnetic induction, the magnetic materials 112 form uniform heating points in the cigarette body 110, so that the tobacco 111 is uniformly heated, achieving high taste consistency, and the tobacco 111 will not be partially charred, thereby avoiding a burnt taste and achieving higher tobacco utilization efficiency. In addition, the addition of the magnetic material 112 causes the heat to be transmitted fast in the tobacco 111, thereby effectively shortening the preheating time and generating vapor quickly.

To achieve a good induction heating effect, a ratio of a volume of the magnetic material 112 to a total volume of the cigarette body 110 is 1% to 30%. In an embodiment, the ratio of the volume of the magnetic materials 112 to the total volume of the cigarette body 110 is 3% to 10%.

The magnetic material 112 is in the shape of particles, and a particle size may range from 10 μm to 200 μm, and range from 50 μm to 150 μm in an embodiment. The magnetic material 112 within the foregoing particle size range can achieve a good induction heating effect and can be easily doped into the tobacco 111 more uniformly.

The magnetic material 112 may be various materials generating heat under the action of electromagnetic induction. Specifically, the magnetic material 112 may be ferromagnetic metal powder, such as Fe powder, Co powder, Ni powder, silicon steel powder, permalloy powder, or Al—Ni—Co powder. In an embodiment, the magnetic material 112 is Fe powder or Ni powder, which has high magnetic conductivity and electrical resistivity and can be heated quickly, and also has high thermal conductivity, thereby achieving high heating uniformity for the cigarette.

The magnetic material 112 may be added into the tobacco 111 in a preparation process of the cigarette 100, to be uniformly distributed in the tobacco 111. For example, the tobacco 111 and the magnetic material 112 may be mixed uniformly in advance, and then the cigarette body 110 is obtained through coating and shaping in a manner of die-casting or thermoforming.

When the cigarette 100 is used in combination with the cigarette device 200, the cigarette can be heated uniformly and generate vapor quickly, to ensure a consistent vaping taste and improve the utilization of the tobacco while achieving immediate vaping and immediate stopping, which helps improve user experience.

In some specific examples, the cigarette 100 may be used as a part of the cigarette device 200, that is, the cigarette device 200 may include the cigarette 100.

This application is further described below by using an embodiment, but the embodiment is not intended to limit this application.

Embodiment 1

A structure of a cigarette device of this embodiment is shown in FIG. 1. The cigarette device 200 includes a housing 201. The housing 201 is provided with a cigarette insertion opening 202. A loading cavity 203 is connected to the cigarette insertion opening 202. An outer side of the cigarette insertion opening 202 is provided with a first air hole 206*a*. A lower part of the housing 201 is located below a lower part of the loading cavity 203 and is provided with a first air hole 206*b*, and a bottom wall of the loading cavity 203 is provided with a second air hole 217. The loading cavity 203 is connected to the housing 201 through an annular support element 210 connected to a bottom of the housing 201, and the support element 210 is provided with a third air hole 218. An electromagnetic induction heating element 204 surrounds the outside of the loading cavity 203, the electromagnetic induction heating element 204 is electrically connected to a power supply 205 and a circuit control unit 209, and the circuit control unit 209 is electrically connected to an airflow sensing apparatus 208. The housing 201 is further provided with a switch 212, a display screen 213, a control button 214, and a charging interface 215. A material of the loading cavity 203 is an alumina ceramic, with a thermal conductivity of 25 W/(m·K).

Tobacco and Fe powder (with a particle size of 100 μm) used as a magnetic material were mixed uniformly and shaped as a cigarette body, where a volume proportion of the Fe powder was 10%. The cigarette body was then connected to a filter, to obtain a cigarette with the structure shown in FIG. 5.

The cigarette was placed into the loading cavity 203 of the cigarette device of this embodiment for vaping tests. Test results are as follows: quick vapor generation, good vapor consistency, a pure taste, and no foreign taste; immediate vaping and immediate stopping are allowed, and after vaping is stopped, the cigarette can be cooled down to 150° C. or below within 1 second, and a good taste can be still obtained when the cigarette is vaped again.

Comparative Embodiment

A cigarette device of this embodiment is a low-temperature baking cigarette device sold on the market, and a heating element thereof is a sheet internal heating plate.

A conventional low-temperature baking cigarette was placed into the cigarette device of this embodiment for vaping tests. Test results are as follows: slow vapor generation, poor vapor taste consistency, and presence of a foreign taste; after vaping is stopped, the temperature of the cigarette decreases slowly and is still in a baked state, that is, once the cigarette device is started, immediate vaping and immediate stopping are not allowed, and an abnormal taste may be generated when the baking of the cigarette is resumed from interruption.

The technical features in the foregoing embodiments may be combined. For concise description, not all possible combinations of the technical features in the embodiments are described. However, provided that combinations of the technical features do not conflict with each other, the combinations of the technical features are considered as falling within the scope described in this specification.

The foregoing embodiments merely express several implementations of this application. The descriptions thereof are relatively specific and detailed, but should not be understood as limitations to the scope of this application. It should be noted that for a person of ordinary skill in the art, several transformations and improvements can be made without departing from the idea of this application. These transformations and improvements belong to the protection scope of this application. Therefore, the protection scope of the patent of this application shall be subject to the appended claims.

What is claimed is:

1. A cigarette device, comprising:

a housing;

a loading cavity, disposed in the housing and configured to load a cigarette;

a fluid channel, located between the loading cavity and the housing, the fluid channel being in communication with an outside of the housing and a loading chamber of the loading cavity;

an airflow sensor, disposed in the housing, the airflow sensor being disposed in the fluid channel to sense an airflow speed in the fluid channel;

a power supply, disposed in the housing;

an electromagnetic induction heating element, surrounding an outside of the loading cavity, the electromagnetic induction heating element being electrically connected to the power supply; and a circuit control unit, disposed in the housing, the circuit control unit being electrically connected to the airflow sensor and the electromagnetic induction heating element, and controlling, according to the airflow speed sensed by the airflow sensor, the electromagnetic induction heating element to work or stop.

2. The cigarette device according to claim 1, wherein a material of the loading cavity is a non-magnetic shielding heat sink material with a thermal conductivity not lower than 20 W/(m·K).

3. The cigarette device according to claim 2, wherein a material of the loading cavity is a ceramic material with a thermal conductivity not lower than 20 W/(m·K).

4. The cigarette device according to claim 1, wherein the housing is provided with a cigarette insertion opening, the loading cavity is connected to the cigarette insertion opening, and the loading chamber of the loading cavity is in communication with the cigarette insertion opening.

5. The cigarette device according to claim 4, wherein the housing is provided with a first air hole in communication with the fluid channel.

6. The cigarette device according to claim 5, wherein there are one or more first air holes, and at least one of the first air holes is provided at an upper part of the housing.

7. The cigarette device according to claim 6, wherein the first air holes are annular through holes surrounding the cigarette insertion opening.

8. The cigarette device according to claim 6, wherein there are a plurality of first air holes, and the plurality of first air holes are arranged on an outer side of the cigarette insertion opening at uniform intervals.

9. The cigarette device according to claim 6, wherein there are a plurality of first air holes, and at least one of the first air holes is provided at a lower part of the housing and located below the loading cavity.

10. The cigarette device according to claim 4, wherein the loading cavity is provided with a second air hole in communication with the fluid channel.

11. The cigarette device according to claim 10, wherein the second air hole is provided at a bottom wall of the loading cavity.

12. The cigarette device according to claim 11, wherein there are a plurality of second air holes, and the plurality of second air holes are uniformly provided at the bottom wall of the loading cavity.

13. The cigarette device according to claim 11, wherein there is one second air hole, and a hole diameter of the second air hole is equal to an inner diameter of the loading cavity.

14. A cigarette device, comprising:

a housing;

a loading cavity, disposed in the housing and configured to load a cigarette;

a fluid channel, located between the loading cavity and the housing, the fluid channel being in communication with an outside of the housing and a loading chamber of the loading cavity;

an airflow sensor, disposed in the housing, the airflow sensor being disposed in the fluid channel to sense an airflow speed in the fluid channel;

a power supply, disposed in the housing;

an electromagnetic induction heating element, surrounding an outside of the loading cavity, the electromagnetic induction heating element being electrically connected to the power supply;

a circuit control unit, disposed in the housing, the circuit control unit being electrically connected to the airflow sensor and the electromagnetic induction heating element, and controlling, according to the airflow speed sensed by the airflow sensor, the electromagnetic induction heating element to work or stop; and a support element, the loading cavity being connected to an inner wall of the housing through the support element.

15. The cigarette device according to claim 14, wherein the housing is provided with a cigarette insertion opening, the loading cavity is connected to the cigarette insertion opening, and the loading chamber of the loading cavity is in communication with the cigarette insertion opening.

16. The cigarette device according to claim 15, wherein there are one or more first air holes, and at least one of the first air holes is provided at an upper part of the housing.

17. The cigarette device according to claim 15, wherein the loading cavity is provided with a second air hole in communication with the fluid channel.

18. The cigarette device according to claim 17, wherein there are a plurality of second air holes, and the plurality of second air holes are uniformly provided at a bottom wall of the loading cavity.

19. The cigarette device according to claim 14, wherein the support element is disposed at a bottom of the loading cavity, and the support element is an annular element.

20. The cigarette device according to claim 19, wherein the support element is provided with a third air hole in communication with the fluid channel.

* * * * *